US009046107B2

(12) United States Patent
Behnke et al.

(10) Patent No.: US 9,046,107 B2
(45) Date of Patent: Jun. 2, 2015

(54) VERTICAL DOUBLE SUCTION PUMP ENCLOSING TUBE SEAL

(75) Inventors: Paul W. Behnke, Seal Beach, CA (US); Matthew J. Koren, Los Angeles, CA (US)

(73) Assignee: ITT MANUFACTURING ENTERPRISES LLC.

( * ) Notice: Subject to any disclaimer, the term of this patent is extended or adjusted under 35 U.S.C. 154(b) by 766 days.

(21) Appl. No.: 13/207,917

(22) Filed: Aug. 11, 2011

(65) Prior Publication Data

US 2013/0039756 A1 Feb. 14, 2013

(51) Int. Cl.

| | |
|---|---|
| ***F04D 29/12*** | (2006.01) |
| ***F04D 29/04*** | (2006.01) |
| ***F04D 29/06*** | (2006.01) |
| ***F04D 1/00*** | (2006.01) |
| ***F04D 29/047*** | (2006.01) |

(52) U.S. Cl.

CPC ..... *F04D 29/126* (2013.01); *F04D 1/006* (2013.01); *F04D 29/0473* (2013.01); *F04D 29/061* (2013.01)

(58) Field of Classification Search

CPC ..... F04D 1/00; F04D 29/08; F04D 29/083; F04D 29/086; F04D 29/10; F04D 29/104; F04D 29/108; F04D 29/12; F04D 29/122; F04D 29/126

USPC ..... 415/170.1, 171.1, 174.2, 174.3, 229, 415/230, 231; 277/389, 391, 392, 393

See application file for complete search history.

(56) References Cited

U.S. PATENT DOCUMENTS

| | | | | | |
|---|---|---|---|---|---|
| 2,363,420 | A | | 11/1944 | Howard | |
| 2,598,484 | A | * | 5/1952 | Adams | 417/423.11 |
| 2,919,148 | A | * | 12/1959 | Smith | 384/482 |
| 2,997,958 | A | | 8/1961 | Heinicke | |
| 3,117,793 | A | * | 1/1964 | Hauser et al. | 277/372 |
| 3,123,010 | A | * | 3/1964 | Witt et al. | 415/173.1 |
| 4,350,372 | A | * | 9/1982 | Logsdon | 285/45 |
| 4,605,234 | A | * | 8/1986 | Metcalf | 277/377 |

(Continued)

FOREIGN PATENT DOCUMENTS

| | | |
|---|---|---|
| EP | 0060109 | 9/1982 |
| EP | 0719941 | 3/1996 |
| JP | 2006029502 | 2/2006 |

OTHER PUBLICATIONS 1 page English Language Translation of JP2006029502 Abstract.

*Primary Examiner* — Edward Look
*Assistant Examiner* — Christopher R Legendre

(57) ABSTRACT

Apparatus is provided featuring a casing assembly, a shaft and an integral bellows type mechanical face seal. The casing assembly has an enclosing tube configured to house a stationary bearing and to contain lubricating oil. The shaft is configured to rotate in relation to the stationary bearing, the shaft having a rotating seal with a rotating sealing face. The integral bellows type mechanical face seal is configured with one end to overlap and couple to the stationary bearing of the enclosing tube, with another end having a stationary sealing face to couple to the rotating sealing face of the shaft, and with an intermediate bellows-like portion arranged under compression to urge the stationary sealing face against the rotating sealing face and to adapt to large variations between the stationary sealing face and the rotating sealing face in order to provide a seal for the lubricating oil contained inside the enclosing tube so as to prevent leakage of the lubricating oil and to isolate and keep clean the lubricating oil.

19 Claims, 4 Drawing Sheets

Bellows Type Mechanical Face Seal Installed on Enclosing Tube of Industrial Double-Suction Vertical Pump

(56) References Cited

U.S. PATENT DOCUMENTS

| | | | | | |
|---|---|---|---|---|---|
| 4,840,384 | A | * | 6/1989 | Dorsch | 277/379 |
| 4,932,846 | A | | 6/1990 | Valentine | |
| 4,992,690 | A | | 2/1991 | Baker | |
| 5,011,166 | A | * | 4/1991 | Watts | 277/379 |
| 5,238,363 | A | | 8/1993 | Thielke et al. | |
| 5,346,361 | A | | 9/1994 | Jurgill et al. | |
| 5,375,854 | A | * | 12/1994 | Carlisle et al. | 277/377 |
| 5,562,406 | A | | 10/1996 | Ooka et al. | |
| 5,605,287 | A | * | 2/1997 | Mains | 239/402 |
| 6,050,788 | A | | 4/2000 | McEwen et al. | |
| 6,196,813 | B1 | | 3/2001 | Turley et al. | |
| 6,224,354 | B1 | | 5/2001 | Brandt et al. | |
| 6,379,127 | B1 | | 4/2002 | Andrews et al. | |
| 6,422,822 | B1 | | 7/2002 | Holmes | |
| 6,854,957 | B2 | | 2/2005 | Shi | |
| 6,939,051 | B2 | * | 9/2005 | Elmgren et al. | 384/477 |
| 7,001,159 | B2 | | 2/2006 | Peterson, Jr. et al. | |
| 7,070,186 | B2 | * | 7/2006 | Creek | 277/391 |
| 2003/0151208 | A1 | * | 8/2003 | Riedl et al. | 277/370 |
| 2005/0248094 | A1 | * | 11/2005 | Roddis et al. | 277/370 |
| 2007/0172367 | A1 | | 7/2007 | Janocko | |
| 2009/0041591 | A1 | | 2/2009 | Brisland | |
| 2013/0039756 | A1 | * | 2/2013 | Behnke et al. | 415/229 |

* cited by examiner

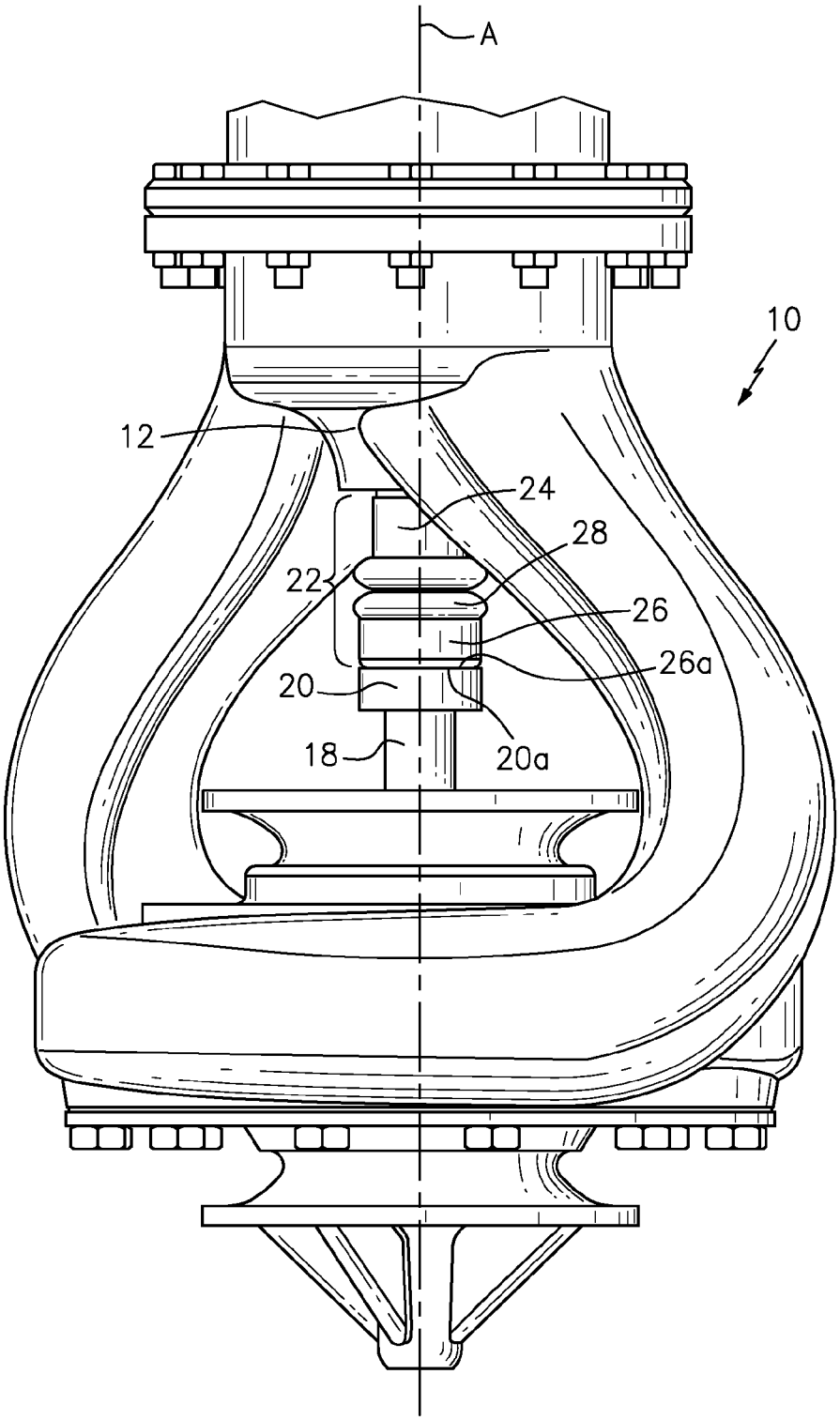
*FIG. 1*: Industry Double–Suction Verticle Pump

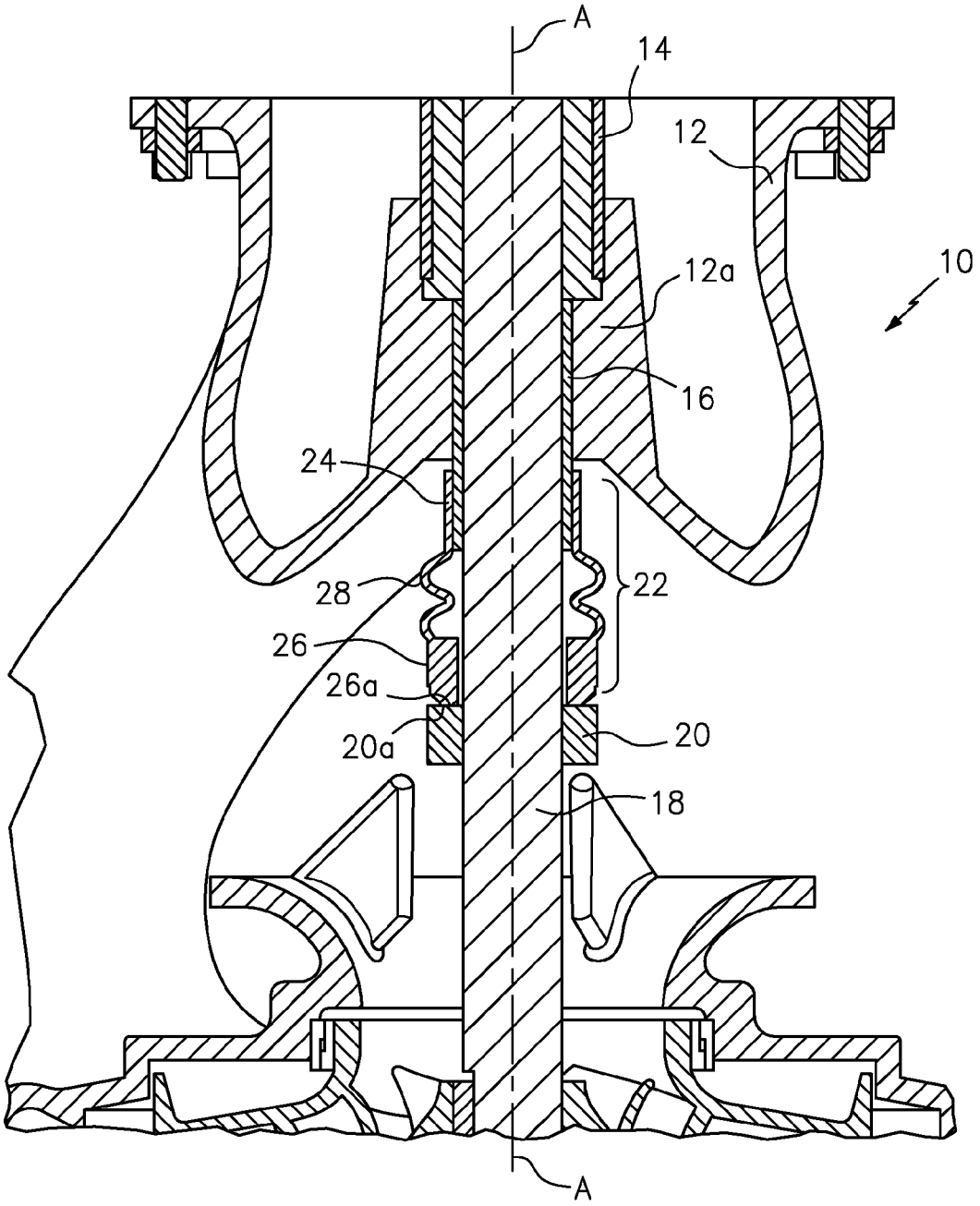
*FIG. 2*: Bellows Type Mechanical Face Seal Installed on Enclosing Tube of Industrial Double–Suction Vertical Pump

*FIG. 3*: Bellows Type Mechanical Face Seal

VERTICAL DOUBLE SUCTION PUMP ENCLOSING TUBE SEAL

BACKGROUND OF THE INVENTION

1. Field of the Invention

The present invention relates to a pump or pumping assembly, arrangement or combination; and more particularly relates to a new technique for sealing a shaft in such a pump or pumping assembly, arrangement or combination, e.g., including a vertical double-suction pump.

2. Brief Description of Related Art

Techniques for sealing shafts are known in the art.

For example, marine shaft sealing technology is known that uses a bellows type mechanical face seal to prevent water from entering the boat hull by way of the propeller shaft. In this known propeller shaft sealing application, the seal faces seal water out of the boat and the faces are cooled by water entering from the inside diameter of the axial clearance between the faces.

In addition, existing industry pump shaft sealing technology is known that uses commercial lip seals to isolate the lubricating oil from the pumpage. However, problems with the existing industry pump shaft sealing technology include the following:

1) During operation, a commercial lip seal achieves only a temporary sealing condition because it uses a radial clearance between the stationary rubber element and the rotating shaft. The rubber elements of lip seals wear rapidly due to abrasion, which allows oil to drain out of the enclosing tube.

2) During idle conditions, a new lip seal retains lubricating oil within the enclosing tube. However, after several weeks of pump operation, the open clearance of a worn lip seal allows the oil to exit and dirty sump fluid to enter into the enclosing tube due to Archimedes' principle.

3) Lip seals rely on a continuous injection of new lubricating oil to purge and restrict dirty sump fluid from the enclosing tube. Oil continually leaks into the environment to compensate for the open radial clearance between the rubber element and the shaft.

Furthermore, shaft sealing arrangements based at least partly on using a spring arrangement are known in the art, by way of example, see U.S. Pat. No. 5,562,406. Sealing arrangements using bellows seals are also known in the art, by way of example, see U.S. Pat. No. 6,422,822.

In view of the aforementioned, there is a long felt need in the industrial pump industry for an improved design or technique that solves the problems related to sealing a shaft in an industrial pump or pumping assembly, arrangement or combination, including a vertical double-suction pump.

SUMMARY OF THE INVENTION

The present invention applies existing marine shaft sealing technology to industrial pumps in an innovative and unique way. By way of example, the present invention provides a new technique for enclosing a tube seal of apparatus, such as a vertical double-suction pump. According to some embodiments of the present invention, the apparatus features, in combination, a casing assembly, a shaft and an integral bellows type mechanical face seal. The casing assembly includes a casing assembly portion and an enclosing tube configured to house a stationary bearing and to contain lubricating oil. The shaft is configured to rotate in relation to the stationary bearing and includes a rotating seal with a rotating sealing face. The integral bellows type mechanical face seal is configured with one end to overlap and couple to the stationary bearing housed in the enclosing tube, with another end having a stationary sealing face to couple to the rotating sealing face of the shaft, and with an intermediate bellows-like portion arranged under compression to urge the stationary sealing face against the rotating sealing face and to adapt to large variations between the stationary sealing face and the rotating sealing face in order to provide a seal for the lubricating oil contained inside the enclosing tube so as to prevent leakage of the lubricating oil and to isolate and keep the lubricating oil clean.

According to some embodiments, the present invention may include one or more of the following features:

The integral bellows type mechanical face seal may be configured to provide a self-adjusting close axial clearance between the stationary sealing face and the rotating sealing face to achieve a sealing condition.

The integral bellows type mechanical face seal may be configured to expand as the stationary sealing face and the rotating sealing face wear so that the position of the stationary sealing face adjusts in relation to the rotating sealing face.

The integral bellows type mechanical face seal may be configured to expand and close the axial clearance between its seal faces during idle conditions so substantially no leakage occurs when the apparatus is idle.

The one end of the bellows type mechanical face seal may be clamped to an end of the enclosing tube, and the rotating sealing face may be secured or fastened to the shaft, e.g., by set screws arranged in threaded openings in the rotating collar.

The apparatus may take the form of a vertical double-suction pump and the enclosing tube, the shaft and the integral bellows type mechanical face seal may be arranged in relation to one another along a vertical axis thereof.

The enclosing tube may be arranged above the integral bellows type mechanical face seal in relation to the vertical axis, and the oil is provided to lubricate the shaft via a gravity feed.

In effect, the present invention applies existing marine shaft sealing technology to industrial pumps by incorporating this sealing technology inside the casing assembly of an industrial vertical double-suction pump to isolate lubricating oil inside the enclosing tube which houses the pump bearings. The lubricating oil is thereby kept clean and retained, which prolongs the life of the pump bearings. This invention improves the existing industry pump technology, which uses commercial lip seals to isolate the lubricating oil, because:

1) During operation, a continuous and long lasting sealing condition is maintained, based at least partly on applying a bellows type mechanical face seal in place of the prior art lip seal. The mechanical face seal utilizes a self-adjusting close axial clearance between its stationary and rotating faces to achieve the sealing condition. As seal face wear occurs, the stationary face adjusts its position to the rotating face by expanding the bellows feature of the mechanical face seal technology. Thereby, bearing life is substantially extended.

2) During idle conditions, the self-adjusting feature of the seal faces cause the axial clearance to close to zero, which thereby maintains substantially perfect isolation and retention of the lubricating oil, based at least partly on applying the bellows type mechanical face seal in place of the lip seal.

3) Minimal leakage of oil into the environment occurs during pump operation and no leakage occurs when the pump is idle, based at least partly on applying the bellows type mechanical face seal in place of the lip seal.

The bellows feature of the bellows type mechanical face seal according to the present invention also has two mechanical advantages in an industrial pump application:

Axial movement of the pump shaft without having to adjust the seal faces. This will allow the seal to be mounted into the shaft before final impeller lift has been set. The seal will not have to be adjusted once the pump is installed (access to the seal after the pump is installed can be impossible in some cases).

Absorbs vibration during operation without damaging seal faces—the carbon element is bored larger than the shaft diameter creating a hydrostatic bearing effect between the carbon element and the shaft, continuously centering the element on the shaft. The hydrostatic bearing effect allows this seal to compensate for vibration and misalignment.

The application of existing marine shaft sealing technology to industrial pumps is unique, because this particular marine shaft seal technology in the form of bellows type mechanical face seals has until now been used exclusively for propeller shaft sealing on boats. The application of bellows type mechanical face seals to enclosing tube sealing in industrial vertical pumps is innovative, because the seal faces seal different liquids in the opposite direction:

In the propeller shaft sealing application, the seal faces seal water out of the boat, and the faces are cooled by water entering from the inside diameter of the axial clearance between the faces.

In comparison, in the industrial pump application the seal faces seal lubrication oil inside the enclosing tube, and the faces are cooled by oil entering from the inside diameter axial clearance between the faces.

The bellow type mechanical face seal may be made up of the following components: a rotating element, set screws, "O"-rings, a carbon seal face, a bellows, and mounting clamps. In the pump application, the bellows component may be clamped to the end of the enclosing tube and the rotating seal face is secured to the pump shaft by the set screws. The rotating element may be located on the shaft in such a way that the bellows is compressed creating a contact force between the two sealing parts. This contact force is what creates a seal while the pump is not in operation.

BRIEF DESCRIPTION OF THE DRAWING

The drawing includes the following Figures, not necessarily drawn to scale:

FIG. 1 is a view of apparatus in the form of a vertical double-suction pump having a bellows type mechanical face seal according to some embodiments of the present invention.

FIG. 2 is a cross-sectional view of the apparatus shown in FIG. 1.

Figure 3A:
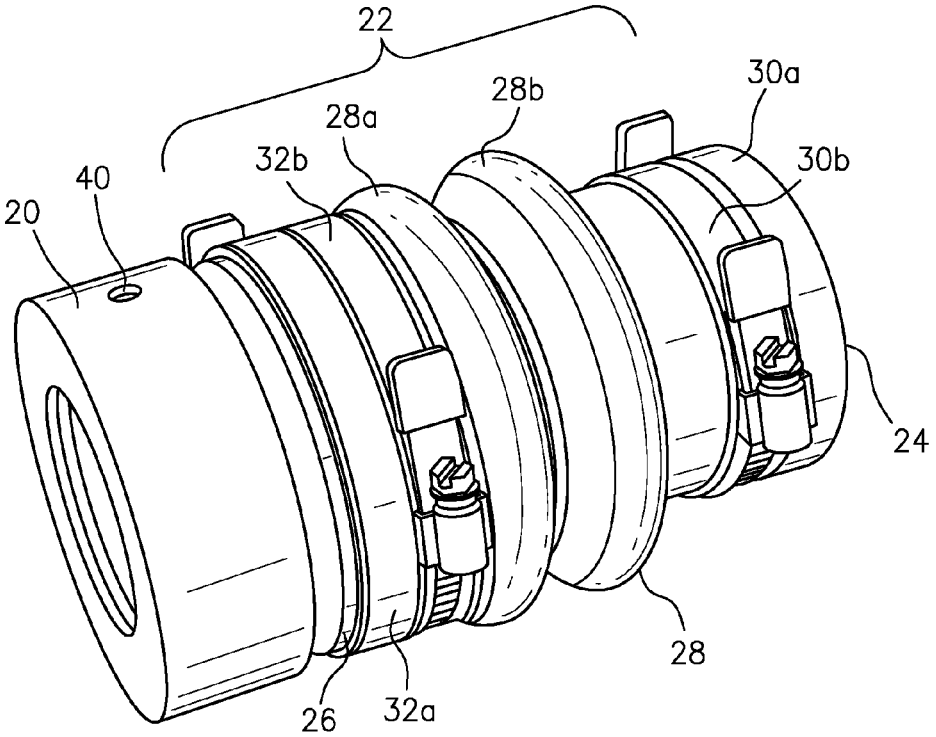
FIG. 3 includes FIGS. 3*a* and 3*b*, which are perspective views of the bellows type mechanical face seal according to some embodiments of the present invention.

In the following description of the exemplary embodiment, reference is made to the accompanying Figures in the drawing, which form a part hereof, and in which is shown by way of illustration of an embodiment in which the invention may be practiced. It is to be understood that other embodiments may be utilized, as structural and operational changes may be made without departing from the scope of the present invention.

DETAILED DESCRIPTION OF THE INVENTION

FIGS. 1 and 2 show apparatus generally indicated as 10 according to some embodiments of the present invention in the form of a vertical double-suction pump. While the present invention will be described by way of example in relation to such a vertical double-suction pump, the scope of the invention is not intended to be limited to the type or kind of pump, pumping assembly, arrangement or combination. For example, embodiments are envisioned in which the present invention is implemented in other types or kinds of pumps, pumping assemblies, arrangements or combinations either now known or later developed in the future.

In FIGS. 1 and 2, the vertical double-suction pump 10 includes a casing assembly 12 having an inner casing assembly portion 12*a* and an enclosing tube 14 configured to house a stationary bearing 16 and to contain lubricating oil inside the enclosing tube 14. The vertical double-suction pump 10 also includes a shaft 18 configured to rotate in relation to the stationary bearing 16, where the shaft 18 is configured with a rotating seal 20 having a rotating sealing face 20*a*. The vertical double-suction pump 10 also includes an integral bellows type mechanical face seal 22 having one end 24 configured to overlap and couple to the stationary bearing 16 housed in the enclosing tube 14, having another end 26 with a stationary sealing face 26*a* configured to couple to the rotating sealing face 20*a* of the shaft 16, and having an intermediate bellows-like portion 28 configured under compression to urge the stationary sealing face 26*a* against the rotating sealing face 20*a* and to adapt to large variations between the stationary sealing face 26*a* and the rotating sealing face 20*a* in order to provide a seal for the lubricating oil contained inside the enclosing tube 14 so as to prevent leakage of the lubricating oil and to isolate and keep clean the lubricating oil.

The integral bellows type mechanical face seal 22 may be configured to provide a self-adjusting close axial clearance between the stationary sealing face 26*a* and the rotating sealing face 20*a* to achieve a sealing condition; to expand as the stationary sealing face 26*a* and the rotating sealing face 20*a* wear so that the position of the stationary sealing face 26*a* adjusts in relation to the rotating sealing face 20*a*; and/or to expand and close the axial clearance between its seal faces 20*a*, 26*a* during idle conditions so substantially no leakage occurs when the apparatus is idle. The integral bellows type mechanical face seal 22 may be made in whole or in part from many different types or kinds of material, as well as combinations of materials, either now known or later developed in the future, including carbon, thermoplastic or metallic material, so as to be flexible and expandable in order to perform the functionality set forth herein. The intermediate bellows-like portion 28 is shown herein having two expanded portions 28*a*, 28*b* (see FIG. 3*a*); however, the scope of the invention is intended to include other intermediate bellows-like portions configured with a different number of expanded portions, including one expanded portion or more than two expanded portions within the spirit of the present invention.

Figure 3B:
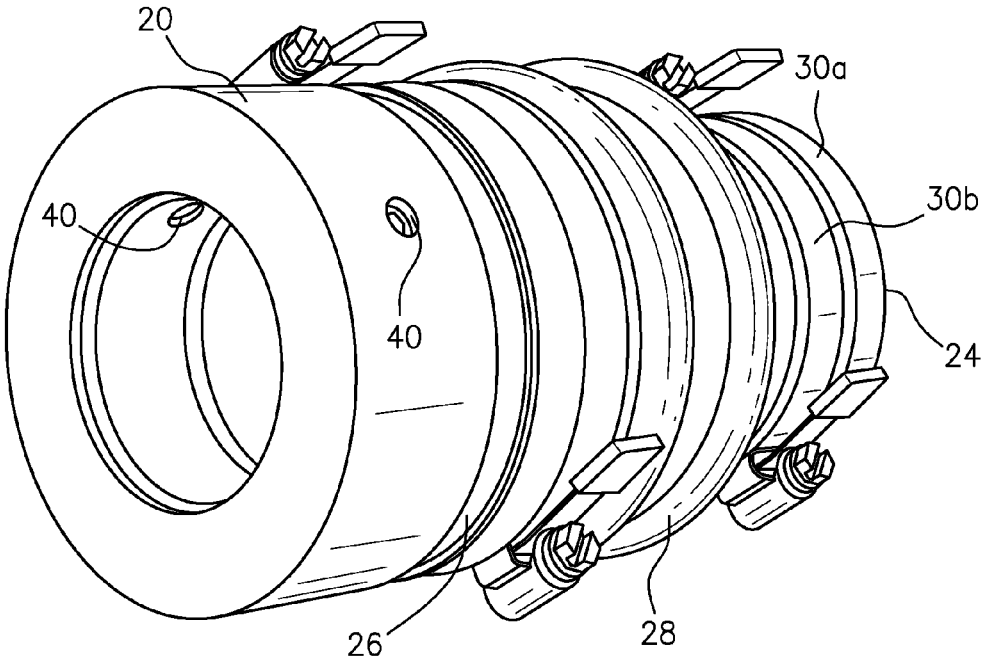
Figure 4:
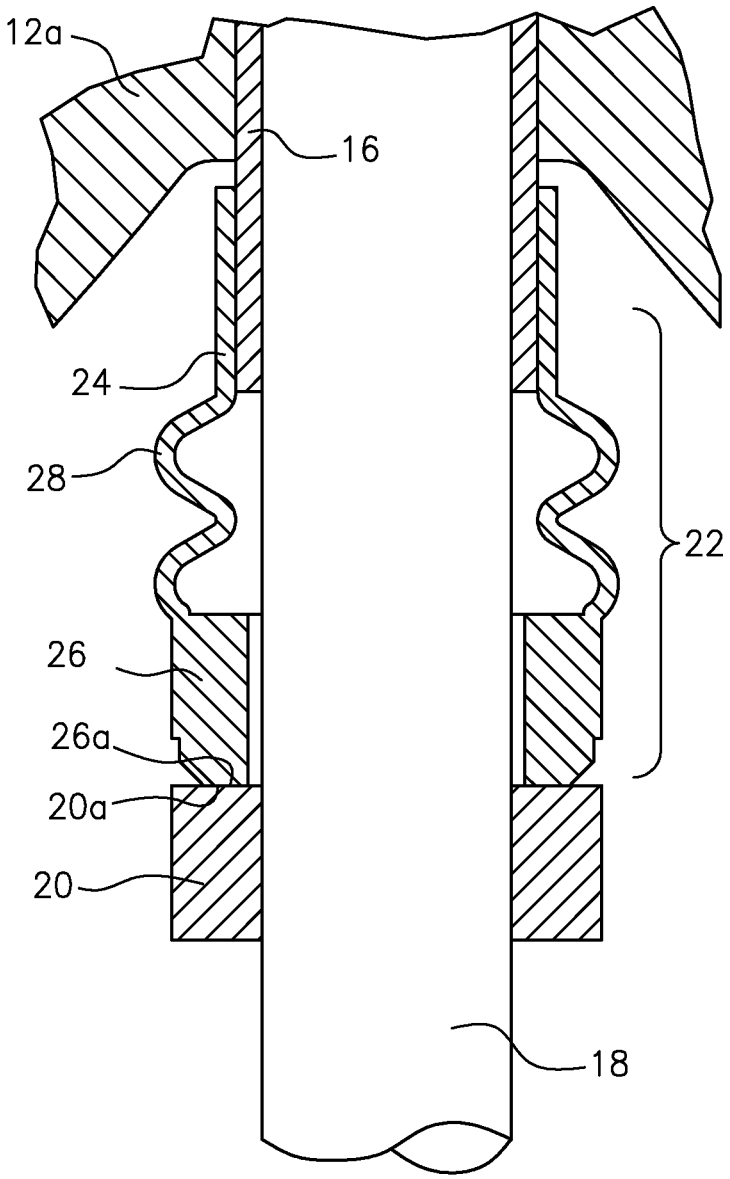
FIG. 4 is a diagram of the bellows type mechanical face seal according to some embodiments of the present invention.

According to some embodiments, e.g., as shown in FIGS. 3*a*, 3*b*, the one end 24 of the bellows type mechanical face seal 22 may be coupled to an end of the enclosing tube 14, e.g., by one or more clamps 30*a*, 30*b*, and the rotating sealing face 20 may be secured to the shaft 18 by one or more set screws (not shown) arranged in threaded openings 40 in the rotating seal 20. The scope of the invention is also intended to include other types or kinds of techniques for coupling the one end 24 of the bellows type mechanical face seal 22 to the end of the enclosing tube 14 either now known or later developed in the future. According to some embodiments, the end 26 of the bellows type mechanical face seal 22 may also be configured with one or more clamps 32*a*, 32*b*.

As shown, the enclosing tube 14, the shaft 18 and the integral bellows type mechanical face seal 22 are arranged in relation to one another along a vertical axis A.

The enclosing tube 14 may be arranged above the integral bellows type mechanical face seal 22 in relation to the vertical axis A, and the lubricating oil is provided via a gravity feed.

The bellows type mechanical face seal 22 is shown and described by way of example as one integral piece for cooperating with the rotating seal 20. However, embodiments are envisioned in which the bellows type mechanical face seal 22 may be configured as more than one piece, e.g., where the end 24, the end 26 and the intermediate portion 28 are formed, e.g., as two or more separate pieces that are coupled together, e.g., by clamping or other suitable means either now known or later developed in the future.

Consistent with that set forth herein, by applying the bellows type mechanical face seal 22 according to the present invention, e.g., in place of the known lip seal, minimal leakage of oil into the environment occurs during pump operation, and substantially no leakage occurs when the pump is idle. The present invention also incorporates this sealing technology inside the casing assembly of the industrial vertical double-suction pump 10 so as to isolate lubricating oil inside the enclosing tube 14 which houses the pump bearings. The lubricating oil is thereby kept clean and retained, which prolongs the life of the pump bearings.

The apparatus 10, e.g., as shown in FIGS. 1 and 2, also includes other elements or components that do not form part of the underlying invention, as would be appreciated by a person skilled in the art, and thus are not described herein in detail, including piping, flanges, an impeller attached to the shaft, nuts and bolts, etc. As a person skilled in the art would also appreciate, the shaft 18 may be coupled to a motor (not shown) arranged in an upper portion of the pump 10 shown in FIGS. 1 and 2.

THE SCOPE OF THE INVENTION

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

What we claim is:

1. A vertical double-suction pump, comprising:

a casing assembly having an inner casing assembly portion and an enclosing tube configured to house a stationary bearing and to contain lubricating oil inside the enclosing tube;

a shaft configured to rotate in relation to the stationary bearing, the shaft having a rotating seal affixed thereto with a rotating sealing face; and an integral bellows type mechanical face seal formed as one piece, having one stationary end that overlaps and clamps to the stationary bearing, having another stationary end with a stationary sealing face that couples to the rotating sealing face of the shaft so as to provide a seal, and having an intermediate bellows-like portion with at least two expanded portions configured under compression to urge the stationary sealing face against the rotating sealing face and to adapt to large variations between the stationary sealing face and the rotating sealing face in order to provide the seal for the lubricating oil contained inside the enclosing tube so as to prevent leakage of the lubricating oil and to isolate and keep clean the lubricating oil, the enclosing tube, the shaft and the integral bellows type mechanical face seal being arranged in relation to one another along a vertical axis of the vertical double-suction pump, and the enclosing tube being arranged above the integral bellows type mechanical face seal in relation to the vertical axis, so the lubricating oil is provided via a gravity feed.

2. A vertical double-suction pump according to claim 1, wherein the integral bellows type mechanical face seal is configured to provide a self-adjusting close axial clearance between the stationary sealing face and the rotating sealing face to achieve a sealing condition.

3. A vertical double-suction pump according to claim 1, wherein the integral bellows type mechanical face seal is configured to expand as the stationary sealing face and the rotating sealing face wear so that the position of the stationary sealing face adjusts in relation to the rotating sealing face.

4. A vertical double-suction pump according to claim 1, wherein the integral bellows type mechanical face seal is configured to expand and close the axial clearance between its seal faces during idle conditions so substantially no leakage occurs when the apparatus is idle.

5. A vertical double-suction pump according to claim 1, wherein the one stationary end of the bellows type mechanical face seal is clamped to an end of the enclosing tube, and the rotating sealing face is secured to the shaft by set screws arranged in threaded openings in the rotating seal.

6. A vertical double-suction pump according to claim 1, wherein the vertical double-suction pump further comprises: a clamp configured to clamp the one stationary end to the stationary bearing of the enclosing tube.

7. A vertical double-suction pump according to claim 1, wherein the integral bellows type mechanical face seal is made in whole or in part from carbon, thermoplastic or metallic material, so as to be flexible and expandable in order to urge the stationary sealing face against the rotating sealing face and to adapt to large variations between the stationary sealing face and the rotating sealing face in order to provide the seal for the lubricating oil contained inside the enclosing tube so as to prevent leakage of the lubricating oil and to isolate and keep clean the lubricating oil.

8. A vertical double-suction pump, comprising:

a casing assembly having an inner casing assembly portion and an enclosing tube configured to house a stationary bearing and to contain lubricating oil inside the enclosing tube;

a shaft configured to rotate in relation to the stationary bearing, the shaft having a rotating seal affixed thereto with a rotating sealing face; and an integral bellows type mechanical face seal formed as one piece, having one stationary end that overlaps and clamps to the stationary bearing, having another stationary end with a stationary sealing face that couples to the rotating sealing face of the shaft so as to provide a seal, and having an intermediate bellows-like portion with at least two expanded portions configured under compression to urge the stationary sealing face against the rotating sealing face and to adapt to large variations between the stationary sealing face and the rotating sealing face in order to provide the seal for the lubricating oil contained inside the enclosing tube so as to prevent leakage of the lubricating oil and to isolate and keep clean the lubricating oil.

9. A vertical double-suction pump according to claim 8, wherein the integral bellows type mechanical face seal is configured to provide a self-adjusting close axial clearance between the stationary sealing face and the rotating sealing face to achieve a sealing condition.

10. A vertical double-suction pump according to claim 8, wherein the integral bellows type mechanical face seal is configured to expand as the stationary sealing face and the rotating sealing face wear so that the position of the stationary sealing face adjusts in relation to the rotating sealing face.

11. A vertical double-suction pump according to claim 8, wherein the integral bellows type mechanical face seal is configured to expand and close the axial clearance between its seal faces during idle conditions so substantially no leakage occurs when the apparatus is idle.

12. A vertical double-suction pump according to claim 8, wherein the one stationary end of the bellows type mechanical face seal is clamped to an end of the enclosing tube, and the rotating sealing face is secured to the shaft by set screws arranged in threaded openings in the rotating seal.

13. A vertical double-suction pump according to claim 8, wherein the enclosing tube, the shaft and the integral bellows type mechanical face seal are arranged in relation to one another along a vertical axis of the vertical double-suction pump.

14. A vertical double-suction pump according to claim 13, wherein the enclosing tube is arranged above the integral bellows type mechanical face seal in relation to the vertical axis, and the lubricating oil is provided via a gravity feed.

15. A vertical double-suction pump according to claim 8, wherein the vertical double-suction pump further comprises: a clamp configured to clamp the one stationary end to the stationary bearing of the enclosing tube.

16. A vertical double-suction pump according to claim 8, wherein the integral bellows type mechanical face seal is made in whole or in part from carbon, thermoplastic or metallic material, so as to be flexible and expandable in order to urge the stationary sealing face against the rotating sealing face and to adapt to large variations between the stationary sealing face and the rotating sealing face in order to provide the seal for the lubricating oil contained inside the enclosing tube so as to prevent leakage of the lubricating oil and to isolate and keep clean the lubricating oil.

17. Apparatus comprising:

a casing assembly having an inner casing assembly portion and an enclosing tube that house a stationary bearing and contain lubricating oil;

a shaft configured to rotate in relation to the stationary bearing, the shaft having a rotating seal affixed thereto with a rotating sealing face; and an integral bellows type mechanical face seal formed as one piece having one stationary end that overlaps and clamps to the stationary bearing, having another stationary end with a stationary sealing face that couples to the rotating sealing face of the shaft so as to provide a seal, and having an intermediate bellows-like portion configured under compression to urge the stationary sealing face against the rotating sealing face and to adapt to large variations between the stationary sealing face and the rotating sealing face in order to provide the seal for the lubricating oil contained inside the enclosing tube so as to prevent leakage of the lubricating oil and to isolate and keep clean the lubricating oil.

18. Apparatus according to claim 17, wherein the apparatus comprises a vertical double-suction pump having a clamp configured to clamp the one end to the stationary bearing of the enclosing tube;

the enclosing tube, the shaft and the integral bellows type mechanical face seal are arranged in relation to one another along a vertical axis of the vertical double-suction pump; and the enclosing tube is arranged above the integral bellows type mechanical face seal in relation to the vertical axis, and the lubricating oil is provided via a gravity feed.

19. Apparatus according to claim 17, wherein the intermediate bellows-like portion comprises at least two expanded portions configured under compression to urge the stationary sealing face against the rotating sealing face.

* * * * *